United States Patent [19]

Iantorno

[11] 4,257,667

[45] Mar. 24, 1981

[54] NON-INSULATED PRINTED CIRCUIT JACK WITH RETAINING FEATURE

[75] Inventor: James Iantorno, Mamaroneck, N.Y.

[73] Assignee: Sealectro Corporation, Mamaroneck, N.Y.

[21] Appl. No.: 19,081

[22] Filed: Mar. 9, 1979

[51] Int. Cl.[2] ..... H01R 9/16

[52] U.S. Cl. ..... 339/221 R; 339/17 C; 339/256 R; 403/242

[58] Field of Search ..... 339/17 C, 275, 256, 339/220, 221; 403/242

[56] References Cited

U.S. PATENT DOCUMENTS

| | | | |
|---|---|---|---|
| 2,317,023 | 4/1943 | Bird | 339/256 S |
| 3,158,425 | 11/1964 | Pritulsky | 339/221 X |
| 3,681,744 | 8/1972 | Olsson | 339/17 C X |
| 3,742,425 | 6/1973 | Peltola | 339/256 R X |
| 3,792,412 | 2/1974 | Madden | 339/17 C |
| 3,803,537 | 4/1974 | Cobaugh | 339/256 R |
| 3,902,153 | 8/1975 | Narozny | 339/17 C X |
| 3,975,078 | 8/1976 | Ammon | 339/221 M |
| 4,076,355 | 2/1978 | Olsson | 339/17 C |

*Primary Examiner*—Joseph H. McGlynn
*Assistant Examiner*—John S. Brown
*Attorney, Agent, or Firm*—Anthony J. Casella; Michael A. Stallman

[57] ABSTRACT

A non-insulated printed circuit board jack includes an outer stepped drawn shell member, and a stamped contact member disposed within the shell for receiving an electrical conductor. The shell member has at one end a minor diameter portion which is freely receivable in an aperture in the printed circuit board. Intermediate its length the shell includes an integral flexible retaining portion which is generally polygonal in cross-section having alternating corner portions and side portions. The corner portions are resistively receivable in the printed circuit board aperture such that when the shell retaining portion is inserted into the aperture the inner circumference of the aperture forces the corner portions of the shell inwardly, and causes the outward expansion of the side portions, whereby the shell retaining portion tends to conform to the configuration of the printed circuit board aperture. By this arrangement, an interference or snug fit is achieved between the connector and the printed circuit board.

7 Claims, 4 Drawing Figures

NON-INSULATED PRINTED CIRCUIT JACK WITH RETAINING FEATURE

BACKGROUND OF THE INVENTION

The subject invention relates to electrical connectors, and specifically, to non-insulated connectors which are used in conjunction with printed circuit boards. One type of connector contemplated is commonly known as a non-insulated pin jack, and consists of a tubular round shell having a closed end and an open end, and a contact member contained within the shell for receiving and retaining a wire lead or pin. The jack is inserted into the hole of a printed circuit where it makes electrical contact with the conductive plating or pad surrounding the printed circuit board hole, and electrically connects the circuitry on the printed circuit board with that connected to a wire lead or pin received within the shell member. Typically shorting jack shells are either machined or drawn components, both types having inherent shortcomings. For example, machined shells are relatively expensive to manufacture, and by necessity, include a larger outside diameter than can be tolerated in many applications. Drawn shells, while able to be formed with smaller outer diameters than machined shells, cannot be readily provided with retention means which permit the use of the connector in printed circuit boards having apertures of varying diameter, and enable the connector to be securely held in place during handling and soldering. For example, knurling is one retention means generally applicable to machined shells. However knurling thin walled, drawn shells of small diameter is relatively costly and often results in incomplete teeth, i.e., large flat areas rather than sharp crests, and thinning of walls at roots due to tool penetration, thus inviting cracking. Another means for providing a retaining feature, is to form corrugations on the surface of the shell. However, this is not practical with thin walled drawn shells, due to the fine pitch usually required for such applications. Similarly, retaining means such as ribs have been found to be impractical. More particularly, ribs are generally formed under high transmitted tool pressure and are not deformable or flexible. Thus, there is positive displacement during insertion into printed circuit board mounting holes causing a direct reduction of the shell inside diameter equal to the interference between the outside diameter over the rib area and the printed circuit board aperture plus double the rib height. This interferes with and prevent a normal spring contact motion.

One further retention means thought of has been the deforming of the drawn shell by externally applied pressure such that the shell is provided with an oval or tri-lobular cross-section. However, such retention means has been found to have several shortcomings. Firstly, jacks including said retention means are generally unable to enter a printed circuit board aperture freely to an acceptable depth and to remain square to the board surface prior to final seating when used in conjunction with multiple piece vacuum loading devices. Secondly, there is often interference with track members and other tooling used when the jacks are inserted by automatic single piece insertion machines. Thirdly, jacks with this retention means have diameters over the tri-lobular configuration which are too large for many applications, the large diameter being dictated by the pin or wire lead diameter, plus the contact outer diameter. It will be noted that the relationship between the shell inside diameter and the contact outside diameter is an important factor with respect to the proper operation of the jacks. For example, limited shell deformation results in loose jacks when the printed circuit board apertures have diameters slightly larger than those of the jacks. Similarly, when the printed circuit board aperture diameters are slightly smaller than those of the jacks, strangulation and deformation of the contact can occur.

It will further be noted that when these round or knurled shells which are loose in the printed circuit board apertures are soldered, objectionable solder joints often appear. Regarding ribbed, oval, or tri-lobed shells, there is often an excess space between specific locations on the shell and the edges of the printed circuit board, again causing soldering problems.

Accordingly, it is an object of the subject invention to provide a non-insulated connector which is relatively inexpensive to manufacture and which can be readily formed so as to be able to be used with printed circuit boards having apertures of varying diameter.

It is a further object of the subject invention to provide a non-insulated printed circuit jack which, after partial insertion into a printed circuit board, remains in a stable, perpendicular position until sufficient axial force is applied thereto to drive the shell of the circuit jack to a desired depth in the printed circuit board.

SUMMARY OF THE INVENTION

In accordance with the above recited objectives, the subject invention provides in one embodiment an electrical connector, namely a non-insulated pin jack, for engagement with a printed circuit board, the printed circuit board having a mounting aperture for receiving the connector. The connector comprises a generally tubular shell member formed from a flexible, electrically conductive material, and a contact member disposed within said shell for receiving and retaining an electrical conductor. The shell member includes a minor diameter portion of a dimension less than that of the mounting aperture of the printed circuit board such that it is freely receivable in the aperture. The shell member further includes an integral retaining portion which is snugly receivable in the printed circuit board mounting aperture. The retaining portion is generally a polygon in cross-section having alternating corner portions and flat side portions, the corner portions being resistively receivable in the printed circuit board mounting aperture, and spaced apart from the contact contained within the connector shell. The sides of the retaining portion are designed so as to be spaced apart from the edge of the printed circuit board aperture when the retaining portion is inserted into said aperture. As the retaining portion of the subject connector is inserted into the printed circuit board aperture, the inner edge of the printed circuit board defining the aperture pushes inwardly against the corners of said retaining portion and effects the outward expansion of the sides such that the retaining portion tends to conform to the configuration of the aperture, thus, providing an interference fit between the connector and the printed circuit board.

Preferably, the retaining portion of the subject connector is generally hexagonal in cross-section having three pairs of opposed corners, the corners of each pair being spaced apart a distance greater than the diameter of the printed circuit board mounting aperture. Thus, the corners will contact the inner edge of the printed circuit board aperture resisting insertion of the connector therein. In another embodiment of the shorting jack of the subject invention, the shell retaining portion is pentagonal in cross-section having five corner portions and five sides. The corners are resistively receivable in the mounting aperture of a printed circuit board such that as the shell retaining portion is inserted into the aperture, the printed circuit board pushes the corners of the retaining portion inwardly and effects the outward expansion of the sides such that the retaining portion tends to conform to the configuration of the printed circuit board mounting aperture.

DESCRIPTION OF THE PREFERRED EMBODIMENTS

Figure 1:
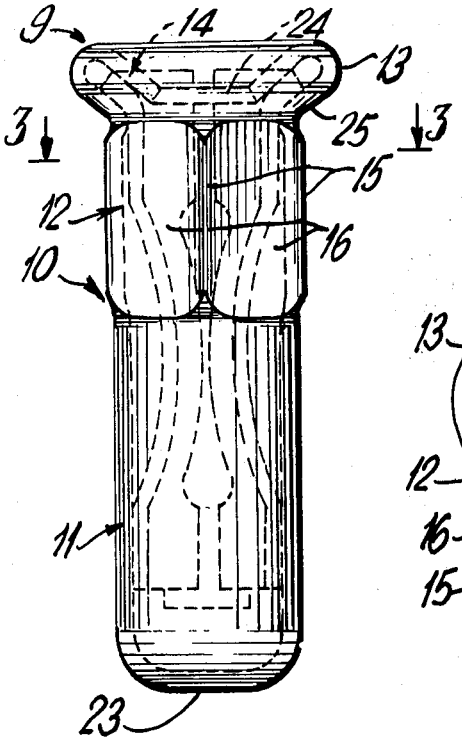
FIG. 1 is an elevational view, phantom in part, of the non-insulated pin jack of the subject invention.

Referring to FIG. 1, the non-insulated pin jack type of connector of the subject invention is designated by reference numeral 9 and includes a generally tubular, unitary shell member 10 having a closed end 23 and an open end 24, and a stamped, contact member 14 disposed within shell 10 for receiving and retaining a wire lead or conductive pin (not shown). Preferably, shell 10 is formed by a drawing process, with the resulting configuration of shell 10 being stepped. Shell 10 is made of an electrically conductive, flexible material, and includes a minor diameter portion 11, a retaining portion 12, and a crown portion 13. As indicated above, the subject connector is contemplated for use with printed circuit boards. Thus, referring to FIGS. 2 and 3, the subject connector 9 is shown engaged with a printed circuit board 5 having mounting aperture 18 for receiving the connector. Although not shown, it will be understood that a conductive plating is disposed around printed circuit board apertures 18 such that an electrical connection can be effected between the circuitry adjacent the apertures 18 and the other circuitry connected to the wire lead or pin received in connector 9. In accordance with the subject invention, minor diameter portion 11 of shell 10 has a diameter less than that of printed circuit board aperture 18 such that minor diameter portion 11 is freely receivable in the aperture. Shell retaining portion 12, on the other hand, is stepped outwardly with respect to minor diameter portion 11, and is specifically configured so as to be resistively receivable in aperture 18. More particularly, referring to FIGS. 1 through 3, shell retaining portion 12 is generally a polygon in cross-section having alternating corner portions 15 and side portions 16. Preferably, shell retaining portion 12 is hexagonal in cross-section with the corner portions 15 being disposed in opposed pairs, the spacing between each opposed corner portion being slightly greater than the diameter of printed circuit board aperture 18. As illustrated in FIG. 3, side portions 16 of shell retaining portion 12 are also disposed in opposed pairs, however, the spacing between each opposed side portion 16 is less than the diameter of printed circuit board aperture 18, thus providing spaces 21 disposed between side portions 16 and the printed circuit board inner edge 19 defined by aperture 18. It will be noted that because of the configuration of retaining portion 12 there are also spaces 17 disposed between contact member 14 and corner portions 15. The importance of the provision of spaces 17 and 21 will be discussed below.

Figure 2:
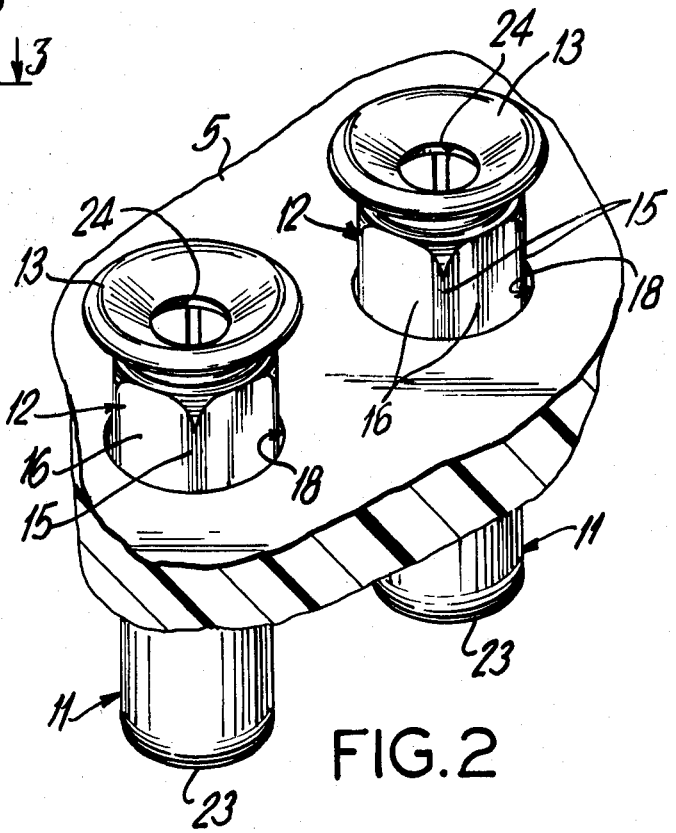
FIG. 2 is a perspective view, sectioned in part, illustrating two non-insulated pin jacks of the subject invention inserted into a printed circuit board.
Figure 3:
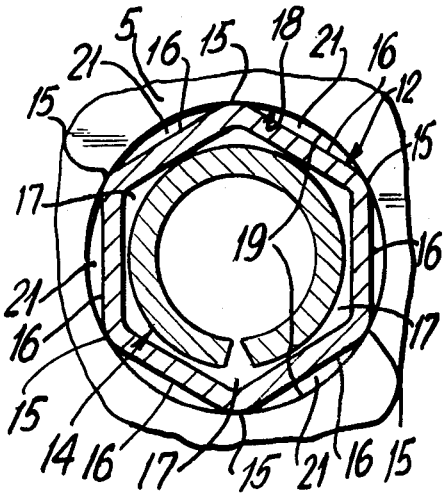
FIG. 3 is a cross-sectional view of the non-insulated pin jack of the subject invention taken along line 3—3 of FIG. 1.

Further referring to FIGS. 1 and 2, it will be noted that shell crown portion 13, which may be generally annular in configuration, is outwardly stepped with respect to retaining portion 12, and has a diameter greater than the diameter of printed circuit board aperture 18 such that said crown portion cannot pass through aperture 18. Preferably, crown portion 13 includes an inclined neck portion 25, the incline of neck 25 typically being on the order of 45° with respect to the horizontal. It will be further noted that crown 13 includes the aperture 24 for receiving a wire lead or pin.

In operation, connector 9 is inserted into printed circuit board aperture 18, with minor diameter portion 11 thereof being freely receivable therein. Once retaining portion 12 reaches aperture 18, corner portions 15 thereof contact aperture edge 19 thus interfering with the continued insertion of the connector. Referring to FIG. 3, as additional axial force must be applied to the connector to continue insertion thereof. At such time, printed circuit board edge 19 acts on retaining portion corners 15 so as to push them inwardly, thus facilitating full insertion of the connector. It will be noted that this inward movement of corners 15 is effected because of the flexibility of the material from which shell 10 is formed, along with the provision of spaces 17 between corners 15 and contact 14. It will be further noted that the inward moving of corners 15 effects the radially outward movement of side portions 16 because of the flexibility of shell 10 and the provision of spaces 21 between printed circuit board edge 19 and side portions 16. Thus, the shell retaining portion tends to conform to the round configuration of printed circuit board aperture 18 and forms an interference or snug fit therewith, thereby facilitating handling and soldering. It will be noted that when connector 9 is fully inserted, inclined neck portion 25 of crown 13 contacts the surface of the printed circuit board and prevents the connector from passing through aperture 18. It will be further noted that while crown portion 13 is depicted in the figures as being generally annular in configuration, it may be of other configurations, such as hexagonal.

Figure 4:
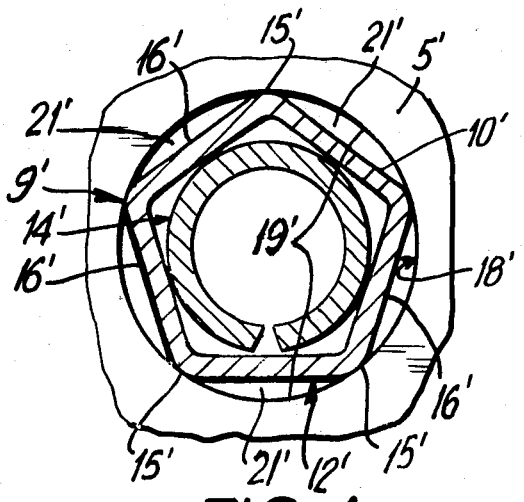
FIG. 4 is a cross-sectional view, similar to that in FIG. 3, of an alternate embodiment of the retaining portion of the non-insulated pin jack of the subject invention.

FIG. 4 illustrates an alternate embodiment of the shorting jack of the subject invention. The jack 9' includes a generally tubular shell member 10' and a contact member 14' disposed within the shell. More particularly, FIG. 4 illustrates a cross-sectional view of a shorting jack 9' engaged within an aperture 18' of a printed circuit board 5'. Shorting jack 9' includes a shell retaining portion 12' which is generally pentagonal in cross-section having five corners 15' and five sides 16' arranged in alternating relationship. In accordance with the subject invention, retaining portion 12 is designed such that corners 15' are resistively receivable in printed circuit board aperture 18', while being spaced apart from contact 14' by spaces 17'. In addition, retaining portion 12' is designed such that when inserted initially in printed circuit board 5', sides 16' are spaced from aperture edge 19′ by spaces 21′. As with the previously described embodiment of the subject invention, upon insertion of connector 9′ in printed circuit board aperture 18′, the inner edge 19′ of the printed circuit board pushes inwardly on retaining portion corners 15′ so as to enable the retaining portion to be fully inserted. Simultaneously, the sides 16′ of retaining portion 12′ outwardly expand as a result of the action on corners 15′, such that retaining portion 12′, as a whole, tends to conform to the configuration of printed circuit board aperture 18′ effecting an interference or snug fit between the connector and the printed circuit board for facilitating handling and soldering operations.

In summary, the subject invention provides a new and improved non-insulated, printed circuit pin jack which includes a retaining feature for enabling the connector to be readily used with printed circuit boards having apertures of varying diameter. In addition, the specific construction of the subject connectors provides a device whose geometry can be tooled readily, thus reducing tooling and fabricating costs. In the preferred embodiments, the shell is drawn and is of stepped configuration, while the inner contact is preferably manufactured by a stamping process. Such specific construction also improved conditions for automatic feeding and assembly of the connectors, as well as improving soldering conditions. Further, because of their specific construction, the connectors need not be fully inserted to effect a snug fit with a printed circuit board, thus eliminating the need for beads, collars, or washers which are presently used with known connectors to maintain specific heights above the surface of printed circuit boards.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

I claim:

1. An electrical connector for engagement with a printed circuit board, said printed circuit board having a circular aperture for receiving said connector, said connector comprising:

a generally tubular unitary shell member formed from a flexible, electrically conductive material, said shell member being a drawn tube having a closed bottom end and an open top end, with the circumference of said shell member being continuous throughout the length thereof, and a tubular contact member formed from an electrically conductive material, said tubular contact member being disposed within and fixedly connected at one end thereof to the open end of said shell for receiving and retaining an electrical conductor, said shell member including:

an integral minor diameter portion disposed adjacent the bottom closed end of the shell member, said minor diameter portion being generally circular in cross-section, with the diameter thereof being less than the diameter of the circular aperture in said printed circuit board and greater than the diameter of said tubular contact member, said minor diameter portion thereby being freely receivable in said printed circuit board aperture; and an integral, flexible retaining portion disposed intermediate the length of the shell member, said retaining portion being generally a polygon in cross-section having alternating corner portions and side portions, said corner portions and side portions being disposed in opposed pairs, each corner portion of an opposed pair of corner portions being spaced a distance greater than the diameter of the circular aperture in said printed circuit board, said corner portions thereby being resistively receivable in said printed circuit board aperture, such that when said retaining portion is inserted into said printed circuit board aperture the inner edge of the printed circuit board defining said printed circuit board aperture pushes inwardly on said corner portions and effects the outward expansion of said side portions whereby said retaining portion tends to conform to the configuration of said printed circuit board aperture and provide an interference fit between said retaining portion and said printed circuit board.

2. An electrical connector as recited in claim 1 in which said retaining portion is generally hexagonal in cross-section, having three pairs of opposed corner portions and three pairs of opposed side portions.

3. An electrical connector as recited in claim 1 which further includes an integral crown portion formed at the open end of the shell member and being of a diameter greater than that of the printed circuit board aperture.

4. An electrical connector as recited in claim 1 wherein the shell is drawn, and the contact member is formed by stamping.

5. An electrical connector as recited in claim 3 in which said crown portion is generally annular in cross-section.

6. An electrical connector for engagement with a printed circuit board, said printed circuit board having a circular aperture for receiving said connector, said connector comprising:

a generally tubular unitary shell member formed from a flexible electrically conductive material, said shell member being a drawn tube having a closed bottom end and an open top end, with the circumference of said shell member being continuous throughout the length thereof, and a tubular contact member formed from an electrically conductive material, said tubular contact member being disposed within and fixedly connected at one end thereof to the open end of said shell for receiving and retaining an electrical conductor, said shell member including:

an integral minor diameter portion disposed adjacent the bottom closed end of the shell member, said minor diameter portion being generally circular in cross-section, with the diameter thereof being less than the diameter of the circular aperture in said printed circuit board and greater than the diameter of said tubular contact member, said minor diameter portion thereby being freely receivable in said printed circuit board aperture; and an integral, flexible retaining portion disposed intermediate the length of the shell member, said retaining portion being generally a pentagon in cross-section having alternating corner portions and side portions, and wherein the diameter of an imaginary circle whose perimeter coincides with the corner portions of said pentagon is greater than the diameter of the circular aperture in said printed circuit board, said corner portions thereby being resistively receivable in said printed circuit board aperture, such that when said retaining portion is inserted into said printed circuit board aperture, the inner edge of the printed circuit board defining said printed circuit board aperture pushes inwardly on said corner portions and effects the outward expansion of said side portions whereby said retaining portions tends to conform to the configuration of said printed circuit board aperture and provide an interference fit between said retaining portion and said printed circuit board.

7. An electrical connector for engagement with a printed circuit board, said printed circuit board having a circular aperture for receiving said connector, said connector comprising:

a generally tubular unitary shell member formed from a flexible, electrically conductive material, said shell member being a drawn tube having a closed bottom end and an open top end, with the circumference of said shell member being continuous throughout the length thereof, and a tubular contact member formed from an electrically conductive material, said tubular contact member being disposed within and fixedly connected at one end thereof to the open end of said shell for receiving and retaining an electrical conductor, said shell member including:

an integral minor diameter portion disposed adjacent the bottom closed end of the shell member, said minor diameter portion being generally circular in cross-section, with the diameter thereof being less than the diameter of the circular aperture in said printed circuit board and greater than the diameter of said tubular contact member, said minor diameter portion thereby being fully receivable in said printed circuit board aperture; and an integral, flexible retaining portion disposed intermediate the length of the shell member, said retaining portion being generally a polygon in cross-section having alternating corner and side portins, and wherein the diameter of an imaginary circle whose perimeter coincides with the corner portions of said polygon is greater than the diameter of the circular aperture in said printed circuit board, said corner portions thereby being resistively receivable in said printed circuit board aperture, such that when said retaining portion is inserted into said printed circuit board aperture the inner edge of the printed circuit board defining said printed circuit board aperture pushes inwardly on said corner portions and effects the outward expansion of said side portion whereby said retaining portion tends to conform to the configuration of said printed circuit board aperture and provide an interference fit between said retaining portion and said printed circuit board.

* * * * *